US011415277B2

(12) United States Patent
Tao

(10) Patent No.: US 11,415,277 B2
(45) Date of Patent: Aug. 16, 2022

(54) LAMPSHADE AND LAMP

(71) Applicant: Shenzhen Nshining Electronics Technology Co., Ltd., Shenzhen (CN)

(72) Inventor: Yuanfang Tao, Shenzhen (CN)

(73) Assignee: Shenzhen Nshining Electronics Technology Co., Ltd., Shenzhen (CN)

( * ) Notice: Subject to any disclaimer, the term of this patent is extended or adjusted under 35 U.S.C. 154(b) by 100 days.

(21) Appl. No.: 17/044,183

(22) PCT Filed: Jul. 4, 2018

(86) PCT No.: PCT/CN2018/094500
§ 371 (c)(1),
(2) Date: Sep. 30, 2020

(87) PCT Pub. No.: WO2019/184130
PCT Pub. Date: Mar. 10, 2019

(65) Prior Publication Data

US 2021/0054975 A1 Feb. 25, 2021

(30) Foreign Application Priority Data

Mar. 30, 2018 (CN) ..... 201810304878.2

(51) Int. Cl.
*F21S 4/28* (2016.01)
*F21V 3/02* (2006.01)
(Continued)

(52) U.S. Cl.
CPC ..... *F21S 4/28* (2016.01); *F21V 3/02* (2013.01); *F21V 17/164* (2013.01); *F21Y 2103/10* (2016.08); *F21Y 2115/10* (2016.08)

(58) Field of Classification Search
CPC .. F21V 5/04; F21V 17/164; F21V 3/02; F21S 4/28
See application file for complete search history.

(56) References Cited

U.S. PATENT DOCUMENTS

2016/0327237 A1* 11/2016 Hoch ..... F21S 8/00

FOREIGN PATENT DOCUMENTS

CN 105972452 A 9/2016
CN 205690314 U 11/2016
(Continued)

OTHER PUBLICATIONS

International Search Report for International Application No. PCT/CN2018/094500, dated Dec. 12, 2018, 4 pages.
(Continued)

*Primary Examiner* — Karabi Guharay
(74) *Attorney, Agent, or Firm* — Holland & Hart LLP

(57) ABSTRACT

Provided are a lampshade and a lamp. The lampshade includes a lampshade bottom, a lampshade wall, stop blocks and clamping blocks. An accommodation cavity is formed by an inner surface of the lampshade bottom, an end surface is provided on an outside of the lampshade bottom, and the end surface is arranged around the accommodation cavity. The lampshade wall is arranged on the end surface and is arranged around the accommodation cavity. A platform surface is provided between an inner surface of the lampshade wall and the inner surface of the lampshade bottom. The platform surface is arranged around the accommodation cavity. The stop blocks are both arranged on the inner surface of the lampshade wall and are separately arranged along an arrangement path of the lampshade wall. The clamping blocks are both arranged on the platform surface and are separately arranged along an arrangement path of the platform surface.

16 Claims, 16 Drawing Sheets

(51) Int. Cl.

| | |
|---|---|
| ***F21V 17/16*** | (2006.01) |
| *F21Y 103/10* | (2016.01) |
| *F21Y 115/10* | (2016.01) |

(56) References Cited

FOREIGN PATENT DOCUMENTS

| | | | |
|---|---|---|---|
| CN | 206429918 | U | 8/2017 |
| CN | 207112718 | U | 3/2018 |
| CN | 208011620 | U | 10/2018 |
| GB | 2170310 | B | 6/1988 |
| JP | H11250719 | A | 9/1999 |
| JP | 4352697 | B2 | 8/2009 |
| KR | 20160109643 | A | 9/2016 |
| KR | 200485548 | Y1 | 1/2018 |

OTHER PUBLICATIONS

Supplemental Search Report issued in CN 2018-103048782, dated Mar. 30, 2018, 1 page.
First Supplemental Search Report issued in CN 2018-103048782, dated Oct. 27, 2019, 1 page.
First Office Action issued in CN 2018-103048782, dated Nov. 5, 2019, 4 pages.
Second Office Action issued in CN 2018-103048782, dated Jul. 14, 2020, 7 pages.
Third Office Action issued in CN 2018-103048782, dated Sep. 24, 2020, 8 pages.

* cited by examiner

LAMPSHADE AND LAMP

CROSS REFERENCE TO RELATED APPLICATIONS

This application is a U.S. National Entry and claims priority to PCT International Patent Application No. PCT/CN2018/094500, filed 4 Jul. 2018, and entitled "LAMPSHADE AND LAMP", which claims priority to Chinese Patent Application No. 201810304878.2 filed 30 Mar. 2018, the entire disclosures of which are incorporated herein by this reference.

TECHNICAL FIELD

The present disclosure relates to the field of lamps, for example, a lampshade and a lamp.

BACKGROUND

In a process of producing a lampshade, a plurality of clamping blocks is arranged on an inner wall of a lampshade bottom of the lampshade such that the lampshade can be installed with an electrical board of a lamp through the clamping blocks. However, in the process, in order to produce the clamping blocks, the mold is generally provided with a large slide block to be attached to an inner surface of the lampshade bottom. At this time, a lower portion of the large slide block abuts against a lower portion of an inner surface of the lampshade, and thus a mold print is printed on the lower portion of the inner surface of the lampshade. The mold print affects not only the beauty of the lampshade, but also a light transmitting effect of the lampshade. In addition, a speed of producing the lampshade is slow and the efficiency is low when the large slide block is used, a manufacturing cost is high due to a large volume of the large slide block, and problems are easy to occur in a movement process of the large slide block due to a large contact area between the large slide block and other parts of the mold. Therefore, the reliability becomes low and a service life of the large slide block is relatively short.

SUMMARY

The present disclosure provides a lampshade and a lamp to solve problems that the arrangement of a large slide block on an inner wall of a lampshade bottom causes a mold print on the lampshade bottom, thus affecting the beauty of the lampshade and a light transmitting effect of the lampshade, a manufactured mold has a high cost, and the large slide block has a short service life.

The present disclosure provides a lampshade, and the lampshade includes a lampshade bottom, a lampshade wall, at least two stop blocks and at least two clamping blocks. An accommodation cavity is defined by an inner surface of the lampshade bottom in a surrounding manner, an end surface is provided outside the lampshade bottom, and the end surface is arranged around the accommodation cavity. The lampshade wall is arranged on the end surface and is arranged around the accommodation cavity, a platform surface is provided between an inner surface of the lampshade wall and the inner surface of the lampshade bottom, and the platform surface is arranged around the accommodation cavity. The at least two stop blocks are each arranged on the inner surface of the lampshade wall and are separately arranged along an arrangement path of the lampshade wall. The at least two clamping blocks are each arranged on the platform surface and are separately arranged along an arrangement path of the platform surface.

In one embodiment, the lampshade wall includes a first straight plate, a second straight plate, a first arc plate and a second arc plate, the first straight plate and the second straight plate are parallel and opposite to each other, a first end of the first straight plate is connected to and transitioned to a first end of the second straight plate through the first arc plate, and a second end of the first straight plate is connected to and transitioned to a second end of the second straight plate through the second arc plate. In addition, the at least two stop blocks are respectively arranged on an inner surface of the first straight plate and an inner surface of the second straight plate, and the at least two clamping blocks are respectively arranged at a position of the platform surface corresponding to an arrangement path of the first straight plate and a position of the platform surface corresponding to an arrangement path of the second straight plate.

In one embodiment, the at least two clamping blocks each include a first baffle and a second baffle. The first baffle is perpendicular to the first straight plate, a first end of the first baffle extends to the first straight plate, a second end of the first baffle is connected to the second baffle, and the second baffle is parallel to the first straight plate.

In one embodiment, the first end of the first baffle extending to the first straight plate includes that the first end of the first baffle extends to the first straight plate and is fixedly connected to the first straight plate.

In one embodiment, each of the at least two clamping blocks is a straight plate, and the straight plate is arranged parallel to the first straight plate.

In one embodiment, the each of the at least two clamping blocks is arranged between two stop blocks of the at least two stop blocks.

In one embodiment, the inner surface of the lampshade bottom is provided with a plurality of bosses, and the plurality of bosses are separately arranged according to the arrangement path of the lampshade wall.

In one embodiment, a surface of each of the plurality of bosses is flush with the platform surface.

In one embodiment, an outer surface of the lampshade bottom is provided with a plurality of grooves, and concave portions of the plurality of the grooves are in interiors of the plurality of bosses in one-to-one correspondence.

In one embodiment, the outer surface of the lampshade bottom is provided with a plurality of fastening positions, and the plurality of the grooves are one-to-one correspondingly arranged in ranges covered by the plurality of the fastening positions.

In one embodiment, each of the at least two stop blocks has a columnar structure with a right-angled trapezoid cross-section.

In one embodiment, each of the at least two stop blocks is formed by groove in a columnar structure with a right-angled trapezoid cross-section.

In one embodiment, in the columnar structure, a plane where a straight-side waist of a right-angled trapezoid is located faces towards the platform surface, a plane where a bevel-side waist of the right-angled trapezoid is located faces away from the platform surface, and a plane where a lower bottom of the right-angled trapezoid is located is connected to the inner surface of the first straight plate.

The present disclosure further includes a lamp including the above-mentioned lampshade.

In the solutions provided by the present disclosure, the clamping blocks do not need to be arranged in the inner surface of the lampshade bottom, so the large slide block does not need to be sleeved in the inner wall of the lampshade bottom, avoiding a mold print being pressed on the inner wall by the large slide block, and improving the light transmitting effect of the lampshade. After no large slide block is needed, only a small slide block is needed to generate a clamping block. The small slide block moves relatively fast, so a production speed of the lampshade can be improved. Moreover, the small slide block has a relatively small volume, so the manufacturing cost is relatively low; and the small slide block has a small contact area with the other portions of the mold, so problems are not easy to occur. Therefore, the reliability becomes high, and the small slide block has a relatively long service life.

DETAILED DESCRIPTION

Figure 1:
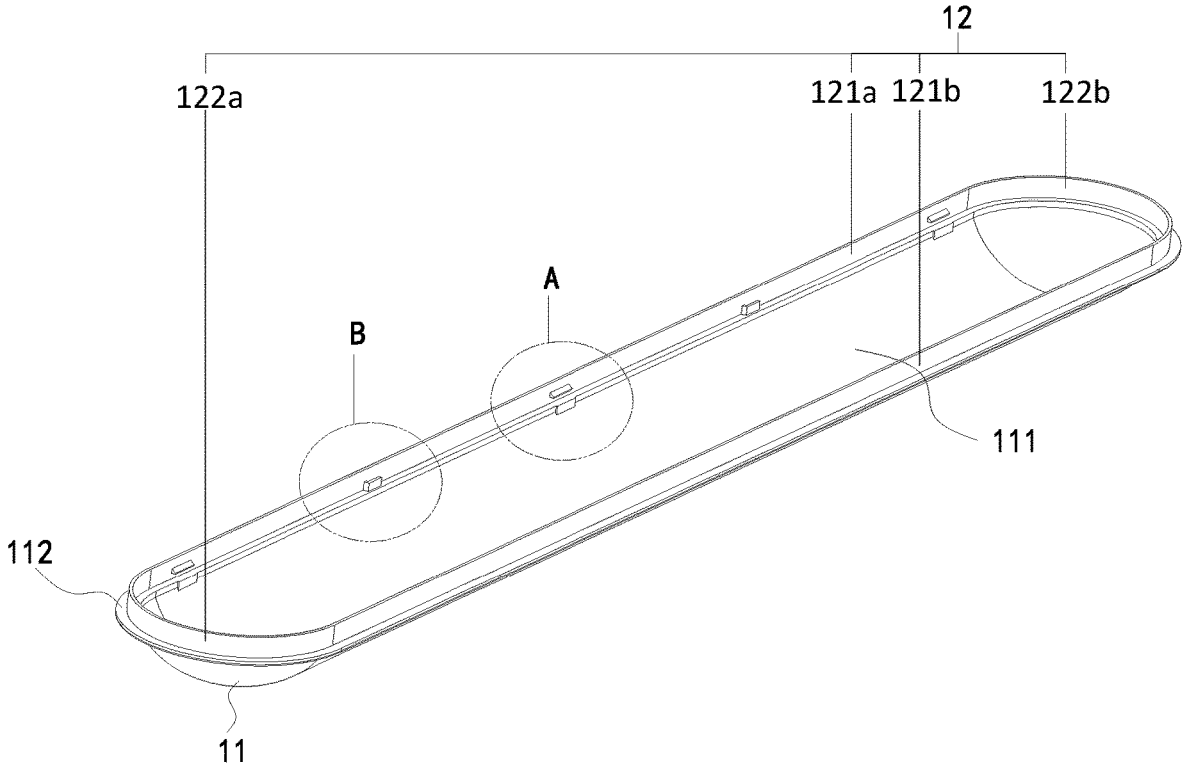
FIG. 1 is a structural schematic diagram of an interior of a lampshade according to an embodiment of the present disclosure.

Solutions in embodiments of the present disclosure will be described below in conjunction with drawings in the embodiments of the present disclosure.

As can be seen from FIG. 1 to FIG. 5, a lampshade 1 described in the embodiment of the present disclosure includes a lampshade bottom 11, a lampshade wall 12, a stop block 14, a clamping block 15 and a boss 16.

Figure 4:
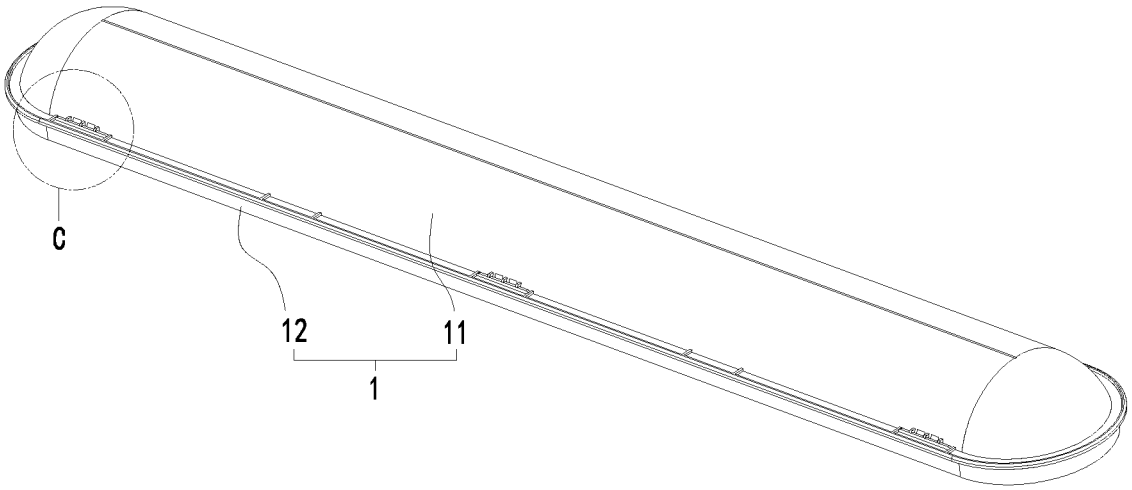
FIG. 4 is a structural schematic diagram of an exterior of a lampshade according to an embodiment of the present disclosure.
Figure 5:
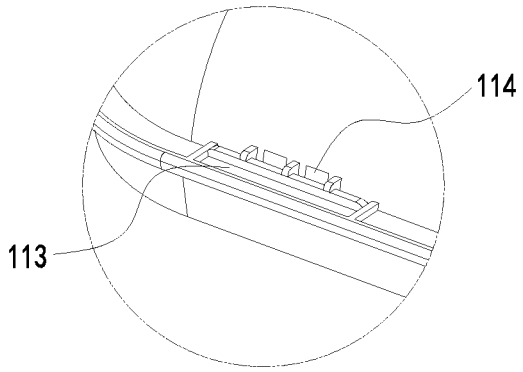
FIG. 5 is an enlarged view of a portion C in FIG. 4.

As shown in FIG. 1, from a top view, the lampshade bottom 11 includes a first straight edge, a second straight edge parallel and opposite to the first straight edge, a first arc edge arranged at a first end of the first straight edge and a first end of the second straight edge, and a second arc edge arranged at a second end of the first straight edge and a second end of the second straight edge, such that a top profile of the lampshade bottom 11 is approximately elliptical. The lampshade bottom 11 has a concave middle portion, such that an accommodation cavity 111 is formed by an inner surface of the lampshade bottom 11. A top surface of the lampshade bottom 11 is an end surface 112, and the end surface 112 is arranged around the accommodation cavity 111. As shown in FIG. 4 and FIG. 5, an outer surface of the lampshade bottom 11 is provided with six fastening positions 113, where three fastening positions of the six fastening positions 113 are separately arranged on the first straight edge of the lampshade bottom 11, and the other three fastening positions of the six fastening positions 113 are separately arranged on the second straight edge of the lampshade bottom 11. Moreover, each fastening position 113 is provided with a groove 14, and each groove 114 is recessed from the outer surface of the lampshade bottom 11 to the inner surface of the lampshade bottom 11.

As shown in FIG. 1, the lampshade wall 12 is arranged on the end surface 112. The lampshade wall 12 includes a first straight plate 121*a*, a second straight plate 121*b*, a first arc plate 122*a* and a second arc plate 122*b*. The first straight plate 121*a* and the second straight plate 121*b* are parallel and opposite to each other. A first end of the first straight plate 121*a* is connected to and transitioned to a first end of the second straight plate 121*b* through the first arc plate 122*a*, and a second end of the first straight plate 121*a* is connected to and transitioned to a second end of the second straight plate 121*b* through the second arc plate 122*b*, such that the lampshade wall 12 may be arranged around the accommodation cavity 111. In addition, referring to FIG. 1 to FIG. 3, an inner surface of the lampshade wall 12 and the inner surface of the lampshade bottom 11 are located in different planes, so a platform surface 13 is formed in a region where the lampshade wall 12 and the lampshade bottom 11 are misaligned; and the platform surface 13 and the end surface 112 of the lampshade bottom 11 are located in a same plane, and the platform surface 13 is also arranged around the accommodation cavity 111.

Figure 2:
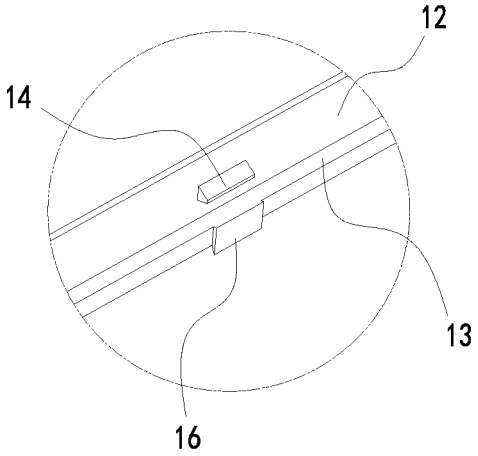
FIG. 2 is an enlarged view of a portion A in FIG. 1.
Figure 6:
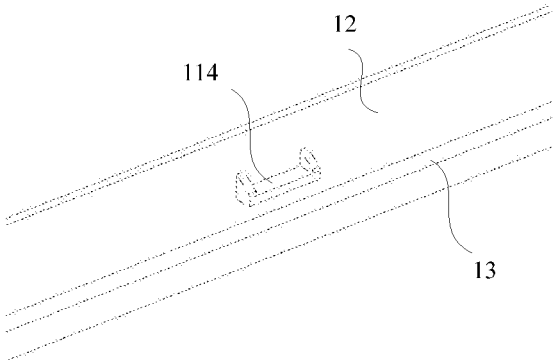
FIG. 6 is a schematic diagram of a portion of a lampshade where a stop block is located according to an embodiment of the present disclosure.

As shown in FIG. 1 and FIG. 2, six stop blocks 14 are provided, where three stop blocks of the six top blocks 14 are arranged at an inner surface of the first straight plate 121*a* of the lampshade wall 12 and are separately arranged in an equally-spaced manner along an arrangement path of the first straight plate 121*a*, and the other three stop blocks of the six stop blocks 14 are arranged at an inner surface of the second straight plate 121*b* of the lampshade wall 12 and are separately arranged in an equally-spaced manner along an arrangement path of the second straight plate 121*b*. In addition, the stop block has a columnar shape with a substantially right-angled trapezoid cross-section, where a bevel-side waist of the right-angled trapezoid faces upward (taking FIG. 1 as a directional reference), and a straight-side waist of the right-angled trapezoid faces downward. In one embodiment, as shown in FIG. 6, each stop block 14 is formed by groove in a columnar structure with a right-angled trapezoid cross-section. In one embodiment, a plane where the straight-side waist of the right-angled trapezoid is located faces towards the platform surface 13, a plane where the bevel-side waist of the right-angled trapezoid is located faces away from the platform surface 13, and a plane where a lower bottom of the right-angled trapezoid is located is connected to the inner surface of the first straight plate 121*a* or the inner surface of the second straight plate 121*b*.

Figure 3:
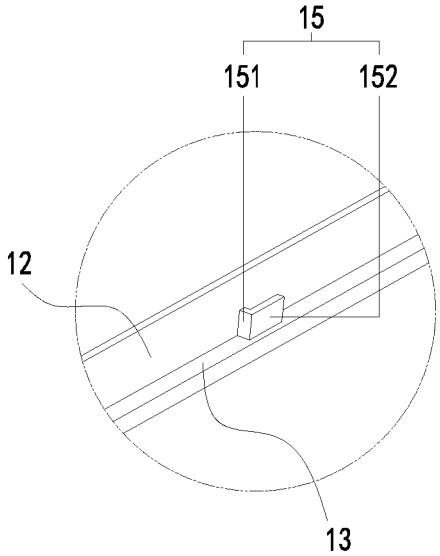
FIG. 3 is an enlarged view of a portion B in FIG. 1.

As shown in FIG. 1 and FIG. 3, four clamping blocks 15 are provided, where two clamping blocks of the four clamping blocks 15 are arranged at positions of the platform surface 13 corresponding to the arrangement path of the first straight plate 121*a* of the lampshade wall 12, the other two clamping blocks of the four clamping blocks 15 are arranged at positions of the platform surface 13 corresponding to the arrangement path of the second straight plate 121*b* of the lampshade wall 12, and each clamping block 15 is arranged between two stop blocks 14. In addition, the clamping block 15 includes a first baffle 151 and a second baffle 152, where the first baffle 151 is perpendicular to the first straight plate 121*a*, a first end of the first baffle 151 extends to the first straight plate 121*a* until the first end of the first baffle 151 is integrally connected to the first straight plate 121*a*, a second end of the first baffle 151 is connected to the second baffle 152, and the second baffle 152 is parallel to the first straight plate 121*a*. In another embodiment, the first baffle 151 is perpendicular to the second straight plate 121*b*, the first end of the first baffle 151 extends to the second straight plate 121*b* until the first end of the first baffle 151 is integrally connected to the second straight plate 121*b*, a second end of the first baffle 151 is connected to the second baffle 152, and the second baffle 152 is parallel to the second straight plate 121*b*.

Figure 7:
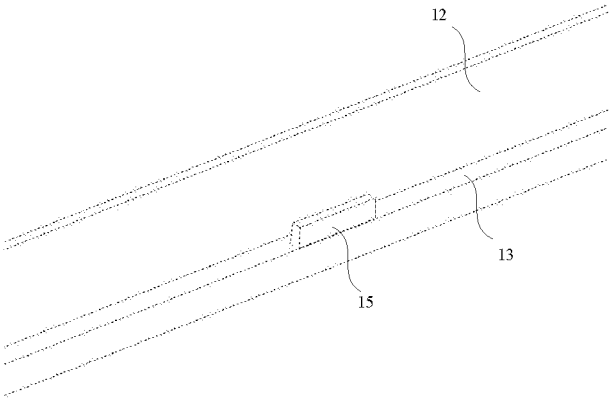
FIG. 7 is a schematic diagram of a portion of a lampshade where a clamping block is located according to an embodiment of the present disclosure.

As shown in FIG. 7, in one embodiment, the clamping block 15 is a straight plate, and a plurality of clamping blocks 15 are parallel to the first straight plate 121 and are arranged on the platform surface 13.

As shown in FIG. 1 and FIG. 2, six bosses 16 are provided, all the six bosses 16 are arranged on the inner surface of the lampshade bottom 11, and top surfaces of the six bosses 16 are flush with the platform surface 13. Referring to FIG. 1, FIG. 2, FIG. 4 and FIG. 5, positions of the six bosses 16 respectively correspond to positions of the six stop blocks 14, and the six grooves 114 are also recessed in interiors of the six bosses 16 in one-to-one correspondence.

In other embodiments, the boss 16 may not be provided. Since the boss 16 has a certain thickness, not providing the boss 16 can not only save materials and reduce costs, but also make the structure of the lampshade 1 simpler and facilitate depanning at the same time.

Referring to FIG. 6, it could be known that after the lampshade 1 is applied to the lamp, an electrical board 5 of the lamp can be assembled and fixed with the lampshade 1. The electrical board 5 has a substantially rectangular shape, and two long edges of the electrical board 5 are both provided with a plurality of mounting notches, and the mounting notches are arranged for being mounted with the stop blocks 14 and the clamping blocks 15. As long as the stop blocks 14 and the clamping blocks 15 are embedded in corresponding mounting notches, the electrical board 5 can be fixed with the lampshade 1.

The above-mentioned embodiment of the lampshade 1 has at least the following beneficial effects.

1. The basic structure of the lampshade 1 in the embodiment may be summarized as follows. The lampshade 1 includes the lampshade bottom 11, the lampshade wall 12, at least two stop blocks 14 and at least two clamping blocks 15. The accommodation cavity 111 is defined by the inner surface of the lampshade bottom 11, the end surface 112 is provided outside the lampshade bottom 11, and the end surface 112 is arranged around the accommodation cavity 111. The lampshade wall 12 is arranged on the end surface 112 and is arranged around the accommodation cavity 111, the platform surface 13 is provided between the inner surface of the lampshade wall 12 and the inner surface of the lampshade bottom 11, and the platform surface 13 is arranged around the accommodation cavity 111. The at least two stop blocks 14 each are arranged on the inner surface of the lampshade wall 12 and are separately arranged along the arrangement path of the lampshade wall 12. The at least two clamping blocks 15 each are arranged on the platform surface 13 and are separately arranged along the arrangement path of the platform surface 13. The basic structure is the main technical feature of the above-mentioned embodiment, and the basic function of the lampshade 1 can be achieved as long as the basic structure is provided. Moreover, since the clamping block 15 is not arranged on the inner surface of the lampshade bottom 11, it is not necessary to use the large slide block to sleeve the inner wall of the lampshade bottom 11 in the producing process, so that the large slide block is prevented from pressing out the mold print on the inner wall of the lampshade bottom 11, thereby improving the light transmitting effect of the lampshade 1. In addition, the lampshade 1 made in this way has many advantages such as low mold cost (compared with a lampshade of a same size adopting a large slide block, a lampshade with a length of about 1.2 meters made by using the solution of the present disclosure can save about 30,000 RMB in cost), fast product injection molding speed, and long service life, which conforms to actual production requirements.

2. The structure of the lampshade wall 12 in the embodiment may be summarized as follows. The lampshade wall 12 includes the first straight plate 121*a*, the second straight plate 121*b*, the first arc plate 122*a* and the second arc plate 122*b*. The first straight plate 121*a* and the second straight plate 121*b* are parallel and opposite to each other, the first end of the first straight plate 121*a* is connected to and transitioned to the first end of the second straight plate 121*b* through the first arc plate 122*a*, and the second end of the first straight plate 121*a* is connected to and transitioned to the second end of the second straight plate 121*b* through the second arc plate 122*b*. The at least two stop blocks 14 are arranged on the inner surface of the first straight plate 121*a* and the inner surface of the second straight plate 121*b*, respectively, and the at least two clamping blocks 15 are arranged at the position of the platform surface 13 corresponding to the arrangement path of the first straight plate 121*a* and the position of the platform surface 13 corresponding to the arrangement path of the second straight plate 121*b*, respectively. Generally, the electrical board 5 has a rectangular shape, so it can be ensured that that lampshade wall 12 with the above-mentioned shape can be matched and installed with the electrical board 5. Meanwhile, a first side of the electrical board 5 and a second side of the electrical board 5 which are opposite to each other can be installed and fixed by the stop blocks 14 and the clamping blocks 15, so as to ensure the structural symmetry of the installation, thus enhancing the fixation effect.

3. The structure of the clamping block 15 in the embodiment may be summarized as follows. The clamping block 15 includes the first baffle 151 and the second baffle 152. The first baffle 151 is perpendicular to the first straight plate 121*a*, the first end of the first baffle 151 extends to the first straight plate 121*a*, the second end of the first baffle 151 is connected to the second baffle 152, and the second baffle 152 is parallel to the first straight plate 121*a*. In other embodiment, the first baffle 151 is perpendicular to the second straight plate 121*b*, the first end of the first baffle 151 extends to the second straight plate 121*b*, the second end of the first baffle 151 is connected to the second baffle 152, and the second baffle 152 is parallel to the second straight plate 121*b*. In a state that the lampshade 1 is assembled with the electrical board 5, a portion of the first side of the electrical board 5 is disposed between the second baffle 152 and the first straight plate 121*a*, and a portion of the second side of the electrical board 5 is disposed between the second baffle 152 and the second straight plate 121*b*, where the second side is opposite to the first side. At this time, the second baffle 152, the first straight plate 121*a*, the second baffle 152 and the second straight plate 121*b* can clamp the electrical board 5 stably, thereby strengthening the fixing of the electrical board 5.

4. The connection relationship between the first baffle 151 and the first straight plate 121*a* in the embodiment may be summarized as follows. The first end of the first baffle 151 extends to the first straight plate 121*a* and is fixedly connected to the first straight plate 121*a*. The connection relationship between the first baffle 151 and the second straight plate 121*b* may be summarized as follows. The first end of the first baffle 151 extends to the second straight plate 121*b* and is fixedly connected to the second straight plate 121*b*. Since the lampshade 1 has a certain length, after the first baffle 151 is fixedly connected to the first straight plate 121*a* or to the second straight plate 121*b*, the first baffle 151 essentially functions as a reinforcing rib, thereby reinforcing the mechanical strength of the lampshade 1.

5. Positions of the clamping blocks 15 in the embodiment may be summarized as follows. Each clamping block 15 is disposed between two stop blocks 14. In a state that the lampshade 1 is assembled with the electrical board 5, the stop block 14 is configured to apply a downward pressure to the electrical board 5, and the clamping block 15 is configured to apply an upward thrust to the electrical board 5. The electrical board 5 is stably clamped through the mutual cooperation between the pressure and the thrust. By adopting the above-mentioned arrangement manner, the electrical board 5 will receive an alternate application of pressure and thrust in turn, thereby ensuring uniform stress and avoiding poor clamping effect for the electrical board 5 due to uneven stress.

6. The structure of the stop block 14 in the embodiment may be summarized as follows. The stop block 14 is formed by groove in the columnar structure with the right-angled trapezoid cross-section. By groove in the columnar structure with the right-angled trapezoid cross-section, the structural strength of the stop block 14 can be ensured, and at the same time, the material used can be saved and the cost of the lampshade 1 can be reduced.

7. The arrangement manner of the boss 16 in the embodiment may be summarized as follows. The inner surface of the lampshade bottom 11 is provided with a plurality of bosses 16, and the plurality of bosses 16 are separately arranged according to the arrangement path of the lampshade wall 12. Since the lampshade 1 has a certain length, providing the plurality of bosses 16 is equivalent to providing a plurality of reinforcing ribs, thereby reinforcing the mechanical strength of the lampshade 1.

8. The relationship between the boss 16 and the platform surface 13 in the embodiment may be summarized as follows. One surface of each boss 16 is flush with the platform surface 13. By adopting the structure, a local portion of the platform surface 13 essentially extends to the middle of the lampshade bottom 11, thereby increasing a plurality of supporting points and avoiding the problem of insufficient supporting area of the electrical board 5.

9. The structure of the groove 114 in the embodiment may be summarized as follows. The outer surface of the lampshade bottom 11 is provided with a plurality of grooves 114, and concave portions of the plurality of the grooves 114 are arranged in interiors of the plurality of bosses 16 in one-to-one correspondence. The addition of the boss 16 will cause a local thickness of the lampshade bottom 11 to be thickened, which will not only increases the materials used, but also causes the thickness of the lampshade 1 to be uneven. Therefore, by adopting the above-mentioned structure, the thickness of the boss 16 can be reduced from the outside, thus not affecting an original function of the boss 16, but also ensuring the thickness consistency of the lampshade 1.

10. The positional relationship between the fastening position 113 and the groove 114 in the embodiment may be summarized as follows. The outer surface of the lampshade bottom 11 is provided with a plurality of fastening positions 113, and the plurality of the grooves 114 are one-to-one correspondingly arranged in ranges covered by the plurality of the fastening positions 113. Since the fastening positions 113 are arranged outside the lampshade 1 so as to facilitate later assembly, if the fastening positions 113 and the grooves 114 are respectively arranged at different parts outside the lampshade bottom 11, an area affecting the light transmission of the lampshade 1 will be increased. Therefore, by adopting the above-mentioned structure, the fastening positions 113 and the grooves 114 are arranged in a same region so as to ensure that an affected area of the lampshade 1 will be further reduced.

Figure 8:
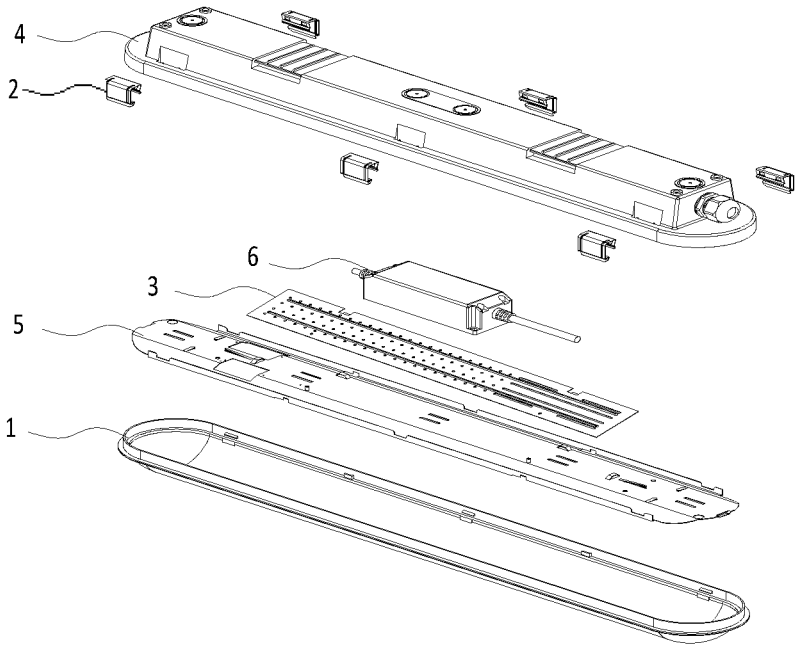
FIG. 8 is an exploded view of a lamp according to an embodiment of the present disclosure.

As shown in FIG. 8, a lamp described in the embodiment of the present disclosure includes a simple fastener 2, a bottom cap 4, a power component 6, a power board 3, an electrical board 5 and the lampshade 1 described in the above-mentioned embodiment. The electrical board 5 is fastened to the interior of the lampshade 1, the power board 3 is mounted on an outer surface of the electrical board 5, the bottom cap 4 is fastened to the lampshade 1 so as to surround the power component 6, and the bottom cap 4 is fixedly fastened to the lampshade 1 by the simple fastener 2.

This embodiment has at least the following beneficial effects.

1. A mold print will not be formed on the lampshade 1, thereby ensuring the light transmitting effect of the lampshade 1.

2. In the related art, the electrical board is mounted in the bottom cap, and the power component is surrounded by the electrical board and the bottom cap. Therefore, when the power component needs to be overhauled, the lampshade must be disassembled from the bottom cap first, and then the electrical board is removed, which brings great inconvenience to the overhaul personnel. In this embodiment, since the electrical board 5 is mounted in the lampshade 1, the power component 6 can be installed outside the lampshade 1, and the power component 6 can be overhauled so long as the lampshade 1 and the bottom cap 4 are disassembled, thus greatly improving the overhaul convenience of the power component 6.

Figure 21:
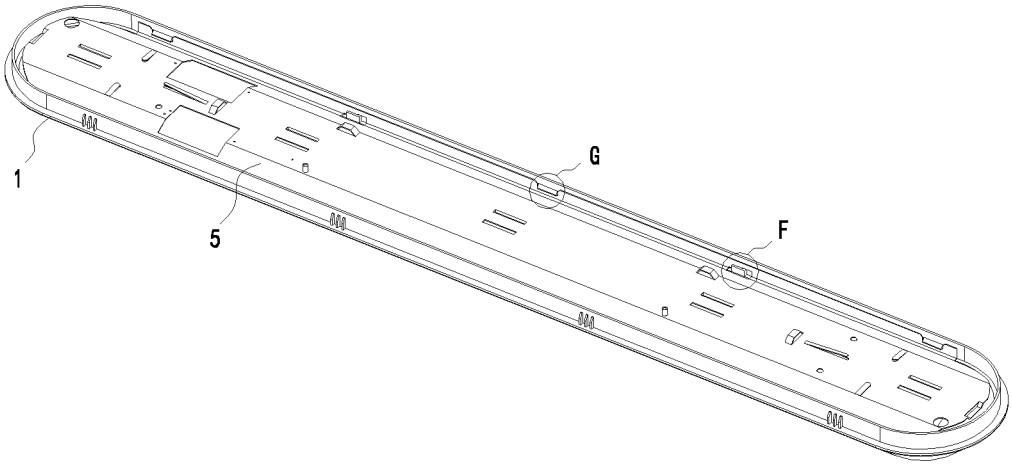
FIG. 21 is a structural schematic diagram of an assembly of a lampshade and an electrical board according to an embodiment of the present disclosure.
Figure 22:
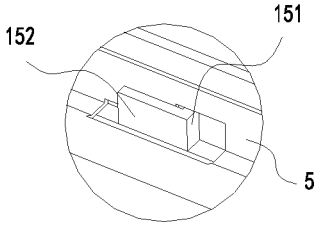
FIG. 22 is an enlarged view of a portion F in FIG. 21.
Figure 23:
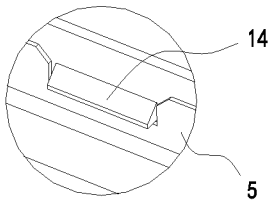
FIG. 23 is an enlarged view of a portion G in FIG. 21.

3. As can be seen from FIG. 21, FIG. 22 and FIG. 23, the clamping block 15 is embedded in a mounting notch at a side portion of the electrical board 5 (the mounting notch is formed by hollowing out the side portion of the electrical board 5 and an edge position of a main body of the electrical board 5), where the first baffle 151 is perpendicularly inserted into the mounting notch at the side portion of the electrical board 5, the second baffle 152 is parallel to an inner surface of the side portion of the electrical board 5, and the second baffle 152 is abutted against the side portion of the electrical board 5, so that the side portion of the electrical board 5 and the inner surface of the lampshade 1 are stably pressed. Moreover, the stop block 14 also presses another mounting notch of the electrical board 5 from up to down (an upper edge of the side portion of the electrical board 5 is recessed downward to form the other mounting notch), thereby preventing the electrical board 5 from being separated from the lampshade 1 in a vertical direction. Since light emitting diode (LED) lamp beads are mounted on the electrical board 5, after the electrical board 5 and the lampshade 1 are installed in the above-mentioned manner, a firm installation of the electrical board 5 and the lampshade 1 can be ensured, thereby providing optimal protection for the light emitting diode (LED).

In one embodiment, the simple fastener includes a connecting sheet 21, a bent sheet 22A, a flap sheet 23, a pressing sheet 24, and first reinforcing rib 25.

Figure 9:
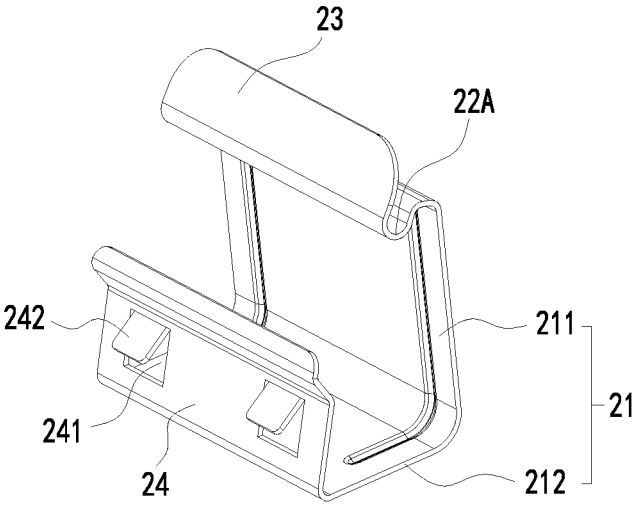
FIG. 9 is a perspective structural schematic view of a first simple fastener in a first view according to an embodiment of the present disclosure.
Figure 11:
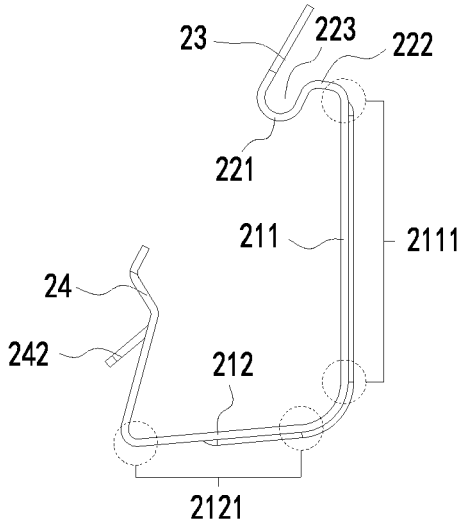
FIG. 11 is a side structural schematic diagram of a first simple fastener according to an embodiment of the present disclosure.

As shown in FIG. 9 and FIG. 11, the connecting sheet 21 includes a first sheet body 211 and a second sheet body 212, and both the first sheet body 211 and the second sheet body 212 have a straight-plate shape. The first sheet body 211 includes two first side portions 2111 opposite to each other, and the second sheet body 212 includes two second side portions 2121 opposite to each other. Referring to directions shown in FIG. 9 and FIG. 11, the two first side portions 2111 are arranged on an upper side and a lower side of the first sheet body 211, respectively, the two second side portions 2121 are arranged on a left side and a right side of the second sheet body 212, respectively, and the first side portion 2111 on the lower side of the first sheet body 211 is connected to the second side portion 2121 on the right side of the second sheet body 212 in a circular arc-transition manner, such that the whole of the connecting sheet 21 is substantially L-shaped. At this time, an inner surface of the first sheet body 211 faces to the left, an outer surface of the first sheet body 211 faces to the right, an inner surface of the second sheet body 212 faces upward, and an outer surface of the second sheet body 212 faces downward.

As shown in FIG. 9 and FIG. 11, the bent sheet 22A is arranged on the left side of the first sheet body 211 such that the bent sheet 22A faces to the inner surface of the first sheet body 211. The bent sheet 22A has two arc portions, where a left arc portion 221 defines an opening 223, and an orientation of the opening 223 is substantially the same as an extending direction of an upper side of the first side portion 2111; and a left side of a right arc portion 222 is connected to a right side of the left arc portion 221, and a right side of the right arc portion 222 is connected to the upper side of the first side portion 2111 in an arc-transition manner, such that an inner surface of the left arc portion 221 is connected to an outer surface of the first sheet body 211 in a transitional manner.

Figure 10:
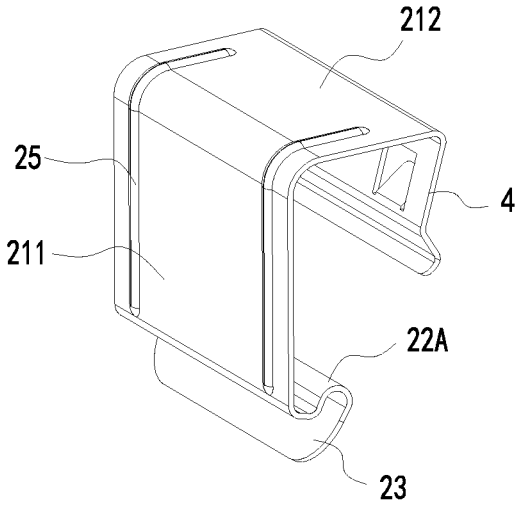
FIG. 10 is a perspective structural schematic view of a first simple fastener in a second view according to an embodiment of the present disclosure.

As shown in FIG. 9 to FIG. 11, the flap sheet 23 is flat, a lower side of the flap sheet 23 is in transitional connection to a left plane of the left arc portion 221, and an upper side of the flap sheet 23 extends above the upper side of the first side portion 2111, such that the flap sheet 23 is substantially inclined from left to right.

As shown in FIG. 9 to FIG. 11, the pressing sheet 24 is disposed on the left side of the first sheet body 211 and is disposed facing to the inner surface of the first sheet body 211, and a lower side of the pressing sheet 24 is connected to a left side of the second sheet body 212 such that the pressing sheet 24 and the second sheet body 212 are connected in a bent shape. A middle portion of the pressing sheet 24 is provided with two grooves 241 which penetrate through two opposite surfaces of the pressing sheet 24, the two grooves 241 are arranged in parallel in a horizontal direction, and an upper groove wall of each of the grooves 241 is connected to an elastic sheet 242 which is turned out to the outer surface of the pressing sheet 24. An upper portion of the pressing sheet 24 is bent twice to form a zigzag shape.

As shown in FIG. 10, two first reinforcing ribs 25 are provided, and the two reinforcing ribs 25 are arranged facing towards edges of opposite sides of the connecting sheet 21, respectively. The first reinforcing ribs 25 are formed by punching the connecting sheet 21 from the inner surface of the connecting sheet 21 to the outer surface of the connecting sheet 21, and extend from the first sheet body 211 to the second sheet body 212.

An application process of the above-mentioned simple fastener is substantially described below.

Figure 12:
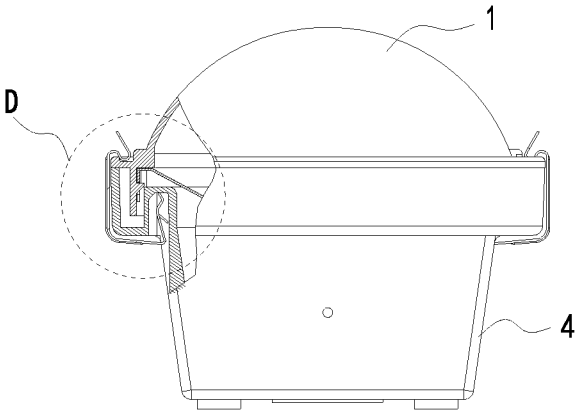
FIG. 12 is a schematic diagram of a first simple fastener in an application state according to an embodiment of the present disclosure.
Figure 13:
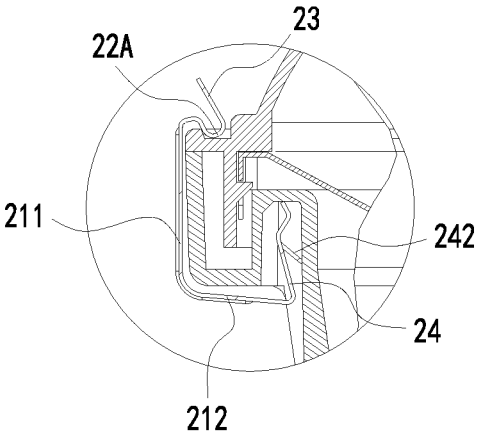
FIG. 13 is an enlarged view of a portion D in FIG. 12.

1. As shown in FIG. 12 and FIG. 13, the pressing sheet 24 is inserted into the fastening position 113 of the lamp bottom cap 4, and then the bent sheet 22A is embedded in the fastening position 113 of the lampshade 1, thereby achieving the assembly and combination of the lamp bottom cap 4 and the lampshade 1.

2. When a force is applied to the flap sheet 23, the flap sheet 23 is turned toward the first sheet body 211, and at this time, the bent sheet 22A moves away from the fastening position 113 of the lampshade 1, thereby achieving separation of the lamp bottom cap 4 from the lampshade 1.

To sum up, the simple fastener of this embodiment has at least the following beneficial effects.

1. The basic structure of the simple fastener in this embodiment may be summarized as follows. The simple fastener includes the connecting sheet 21, the bent sheet 22A, the flap sheet 23, and the pressing sheet 24. The connecting sheet 21 includes the first sheet body 211 and the second sheet body 212. The first sheet body 211 includes two first side portions 2111 opposite to each other, and the second sheet body 212 includes two second side portions 2121 opposite to each other. One first side portion 2111 of the first sheet body 211 is connected to one second side portion 2121 of the second sheet body 212, such that the connecting sheet 21 has a bent shape. The bent sheet 22A faces to the inner surface of the first sheet body 211 and defines the opening 223. The first side of the opening 223 is connected to the other first side portion 2111 of the first sheet body 211, such that the inner surface of the bent sheet 22A is connected to the outer surface of the first sheet body 211 in the transitional manner. The flap sheet 23 is connected to the second side of the opening 223, where the second side of the opening 223 is opposite to the first side of the opening 223, the flap sheet 23 can be turned toward the first sheet body 211, and the bent sheet 22A can reset the flap sheet 23 to a state before the turning. The pressing sheet 24 is connected to the other second side portion 2121 of the second sheet body 212, and the pressing sheet 24 faces to the inner surface of the first sheet body 211. Apparently, the basic structure is the core of the above-mentioned embodiment. After the basic structure is satisfied, the simple fastener 2 can be removed by applying the force to the flap sheet 23, the whole process does not need to borrow other work, so the simple fastener 2 is very convenient to be used, and since there is no need to pry, adjacent components will not be damaged.

2. The shape of the bent sheet 22A in this embodiment may be summarized as follows. A portion of the bent sheet 22A that defines the opening 223 has an arc shape, and the bent sheet 22A and the first side portion 2111 are connected in an arc-transition manner. Whether the simple fastener is installed or removed, a connection portion between the bent sheet 22A and the first sheet body 211 and a connection portion between the bent sheet 22A and the flap sheet 23 are both deformed. If a connection manner with an angle is adopted, a restoration function may also be achieved, but the restoration performance at the connection position with the angle is poor, and the connection position is prone to failure or breakage with the increase of the use times. By adopting the arc-transition structure, the mechanical strength and restoration capability of the connection position can be improved, thereby optimizing the mechanical performance of the connection portions of the bent sheet 22A.

3. The connection manner of the flap sheet 23 in this embodiment may be summarized as follows. The flap sheet 23 is flat, and the flap sheet 23 is connected and transitioned to the opening 223 is transitioned through a plane. Since the flap sheet 23 mainly acts as a force applying member to control the bent sheet 22A to be separated from the fastening position 113 of the lampshade 1, the shape of the flap 23 will not be limited. However, a flap sheet 23 with a complicated shape not only increases the production cost, but may also reduce a force application effect of the flap 23. Therefore, it is apparently more reasonable to adopt the flat flap 23, which not only will not increase the production cost, but also ensures a better force application effect.

4. The connection manner between the first sheet body 211 and the second sheet body 212 in this embodiment may be summarized as follows. The first sheet body 211 is connected and transitioned to the second sheet body 212 is transitioned through an arc. Whether the simple fastener is installed or removed, the connection position between the first sheet body 211 and the second sheet body 212 are deformed. If a connection manner with an angle is adopted, a restoration function of the connecting sheet 21 can be achieved, but the restoration performance at the connection position with the angle is poor, and the connection position is prone to failure or breakage with the increase of the use times. By adopting the arc-transition structure, the mechanical strength and restoration capability of the connection position can be improved, thereby optimizing the mechanical performance of the connection portion between the first sheet body 211 and the second sheet body 212.

5. An arrangement position of the first reinforcing rib 25 in this embodiment may be summarized as follows. A circular arc transition position between the first sheet body 211 and the second sheet body 212 is provided with the first reinforcing rib 25. As the use times increases, the connection position between the first sheet body 211 and the second sheet body 212 tends to cause a phenomenon that the restoration performance is deteriorated or even the connection position is broken, thus when the connection position between the first sheet body 211 and the second sheet body 212 is provided with the first reinforcing rib 25, the mechanical properties of the connection portion can be reinforced, so that not only the breakage phenomenon is not easy to occur, but also the restoration performance of the connection position can be improved.

6. An arrangement path of the first reinforcing rib 25 in this embodiment may be summarized as follows. One end of the first reinforcing rib extends to the first sheet body 211, and the other end of the first reinforcing rib 25 extends to the second sheet body 212. After the first reinforcing rib 25 is added, although the mechanical strength of the connection position between the first sheet body 211 and the second sheet body 212 can be enhanced, the mechanical strength between the first sheet body 211 and the connection position and the mechanical strength between the second sheet body 212 and the connection position are still low. Therefore, when the first reinforcing rib 25 extends to the first sheet body 211 and the second sheet body 212, reinforcing can be performed between the first sheet body 211 and the connection position, and between the second sheet body 212 and the connection position, thereby avoiding the occurrence of the above-mentioned problems.

7. A quantity relation of the first reinforcing rib 25 in this embodiment may be summarized as follows. Two first reinforcing ribs 25 are provided, and the two first reinforcing ribs 25 are arranged facing towards edges of two opposite sides of the connecting sheet 21, respectively. Of course, the number of the first reinforcing ribs 25 is not limited and one or more first reinforcing ribs may be provided. However, the using of one first reinforcing rib 25 can only partially reinforce the connecting sheet 21, while the using of a plurality of first reinforcing ribs 25 will increase the production cost and even affect the restoration performance of the connecting sheet 21. Therefore, using two first reinforcing ribs 25 has a just right effect, not only the restoration performance will not be affected by an excessive number of the first reinforcing ribs 25, but also a consistent mechanical strength of two opposite sides of the connecting sheet 21 is ensured due to a symmetrical arrangement of the two first reinforcing ribs 25.

8. The shape of the pressing sheet 24 in this embodiment may be summarized as follows. An end portion of the pressing sheet 24 has a zigzag shape. Although the end portion of the pressing sheet 24 may be a straight-plate shape, such structure has a poor ability for clamping the lamp bottom cap 4, while when the end portion of the pressing sheet 24 has a zigzag shape, a zigzag portion of the pressing sheet 24 will be slightly deformed as long as the pressing sheet 24 applies a force on and clamp the lamp bottom cap 4, and this deformation will apply an elastic pressure on the lamp bottom cap 4, thereby ensuring that the pressure applied to the lamp bottom cap 4 is always kept at an optimal state.

9. The structure of the pressing sheet 24 in this embodiment may be summarized as follows. The outer surface of the pressing sheet 24 is provided with the elastic sheet 242, when a force is applied on the elastic sheet 242, the elastic sheet 242 can be moved toward the pressing sheet 24, and the elastic sheet 242 can be reset when the force is eliminated. Before the elastic sheet 242 is added, the pressing sheet 24 can only apply a force to and clamp a bottom surface of the fastening position of the lamp bottom cap 4 through the end portion of the pressing sheet 24, while after the elastic sheet 242 is added, the elastic sheet 242 can apply the pressure to a side surface of the buckle position of the lamp bottom cap 4, that is, a lateral clamping force is increased, thus further stabilizing the clamping effect on the lamp bottom cap 4.

10. A positional relationship between the groove 241 and the elastic sheet 242 in this embodiment may be summarized as follows. The pressing sheet 24 is provided with the groove 241, the groove 241 penetrates through two opposite surfaces of the pressing sheet 24, and an edge of the elastic sheet 242 is connected to a groove wall of the groove 241. Generally, the elastic sheet 242 may be connected to the outer surface of the pressing sheet 24 in a welded manner. However, not only welding marks are left, but also elastic restoration capability of the elastic sheet 242 is affected by the welded manner. After the groove 241 is added, the elastic sheet 242 is essentially formed by directly cutting the connecting sheet 21, and then the elastic sheet 242 is bent outside the groove 241, so no welding mark is left, and the elastic restoration capability is relatively strong.

Figure 14:
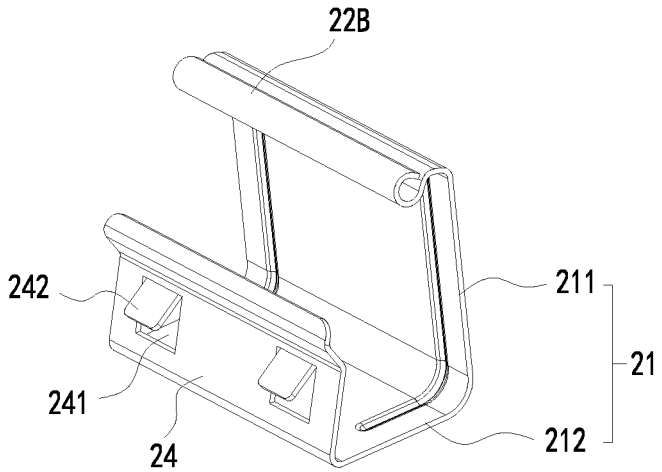
FIG. 14 is a perspective structural schematic view of a second simple fastener in a first view according to an embodiment of the present disclosure.
Figure 15:
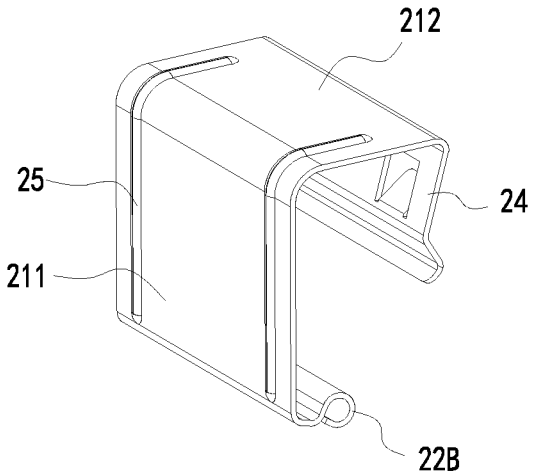
FIG. 15 is a perspective structural schematic view of a second simple fastener in a second view according to an embodiment of the present disclosure.
Figure 16:
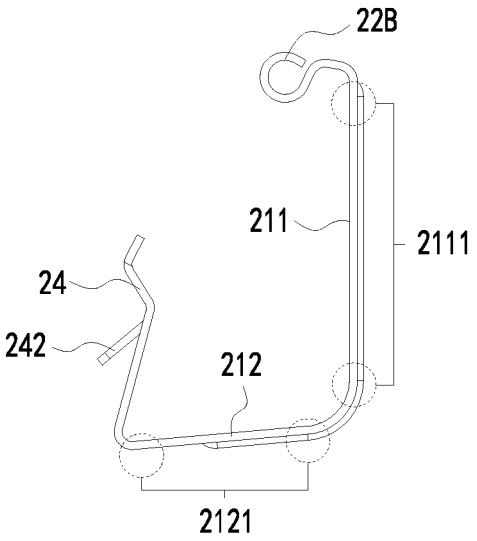
FIG. 16 is a side structural diagram of a second simple fastener according to an embodiment of the present disclosure.

In another embodiment, the simple fastener is basically the same as that in the above embodiment, and the difference between the simple fastener in this embodiment and the simple fastener in the above embodiment is that no flap sheet 23 is provided. As shown in FIG. 14 to FIG. 16, the bent sheet 22B is arranged on a left side of the first sheet body 211 such that the bent sheet 22B faces to the inner surface of the first sheet body 211. A right side of the bent sheet 22B is connected to the upper side of the first side portion 2111 in an arc-transition manner, such that the inner surface of the bent sheet 22B is connected and transitioned to the outer surface of the first sheet body 211. A left side of the bent sheet 22B is folded clockwise to the bent sheet 22B until the bent sheet 22B is sealed, such that a pry position of the bent sheet 22B is adjacent to the outer surface of the first sheet body 211.

An application process of the above-mentioned simple fastener is roughly described below.

Figure 17:
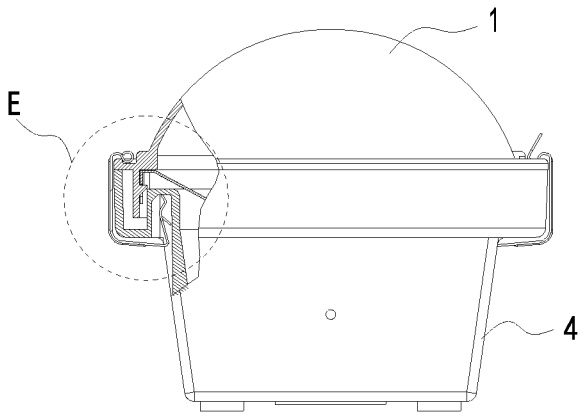
FIG. 17 is a schematic diagram of a second simple fastener in an application state according to an embodiment of the present disclosure.
Figure 18:
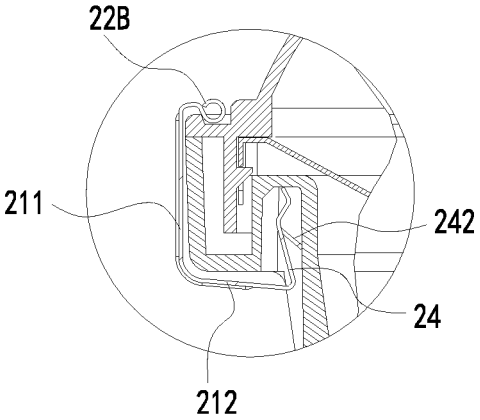
FIG. 18 is an enlarged view of a portion E in FIG. 17.

1. As shown in FIG. 17 and FIG. 18, the pressing sheet 24 is first inserted into the fastening position of the lamp bottom cap 4, and then the bent sheet 22B is embedded in the fastening position 113 of the lampshade 1, thereby achieving the assembly and combination of the lamp bottom cap 4 and the lampshade 1.

2. The pry position of the bent sheet 22B is pried from the outside, such that the bent sheet 22B is moved away from the fastening position 113 of the lampshade 1, thereby achieving the separation of the lamp bottom cap 4 from the lampshade 1.

To sum up, the simple fastener of this embodiment has at least the following beneficial effects.

1. The basic structure of the simple fastener described in this embodiment may be summarized as follows. A lamp fastener includes the connecting sheet 21, the bent sheet 22B, and the pressing sheet 24. The connecting sheet 21 includes the first sheet body 211 and the second sheet body 212. The first sheet body 211 includes two first side portions 2111 opposite to each other, and the second sheet body 212 includes two second side portions 2121 opposite to each other. One first side portion 2111 of the first sheet body 211 is connected to one second side portion 2121 of the second sheet body 212, such that the connecting sheet 21 has a bent shape. The bent sheet 22B faces to the inner surface of the first sheet body 211 and the bent sheet 22B is sealed. The first side of the bent sheet 22B is connected to the other first side portion 2111 of the first sheet body 211, such that the inner surface of the bent sheet 22B is connected and transitioned to the outer surface of the first sheet body 211. The pressing sheet 24 is connected to the other second side portion 2121 of the second sheet body 212, and the pressing sheet 24 faces to the inner surface of the first sheet body 211. Apparently, the basic structure is the core of the above-mentioned embodiment, and after the basic structure is satisfied, the bent sheet 22B may be pried from the outside so as to avoid damage to other components.

2. The shape of the bent sheet 22B in this embodiment may be described as below. A portion of the bent sheet 22B, which is formed in a sealed state, has a circular arc shape. The bent sheet 22B may be formed in a sealed state by using other shapes, but a general bent form has poor deformation resistance, that is, the portion of the bent sheet 22B in the sealed state is prone to deformation or even failure after the bent sheet 22B is pried many times. A circular arc structure has the strong restoration capability and high mechanical strength, so the service life of the lamp fastener can be apparently improved by adopting this manner.

3. The connection manner of the bent sheet 22B in this embodiment may be summarized as follows. The bent sheet 22B is connected and transitioned to the first side portion 2111 through an arc. Whether the lamp fastener is installed or removed, a connection position between the bent sheet 22B and the first sheet body 211 will be deformed. If a connection manner with an angle is adopted, although a restoration function can be achieved, the restoration performance at the connection position with the angle is poor, and the connection position is prone to failure or breakage with the increase of the use times. By adopting the arc-transition structure, the mechanical strength and restoration capability of the connection position can be improved, thereby optimizing the mechanical performance of the connection portion of the bent sheet 22B.

Figure 19:
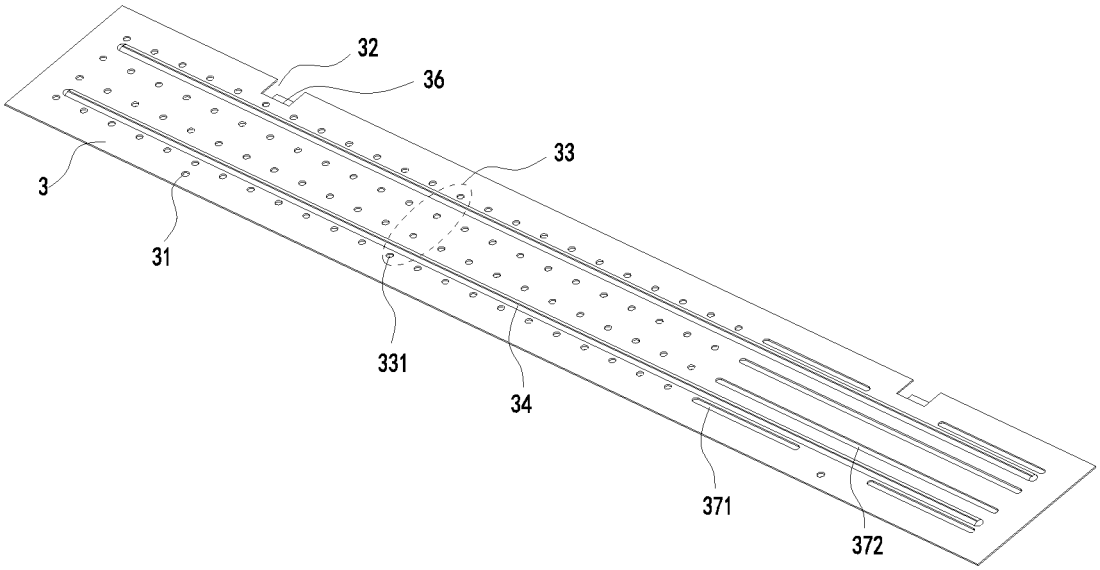
FIG. 19 is a structural diagram of a front side of a power board according to an embodiment of the present disclosure.
Figure 20:
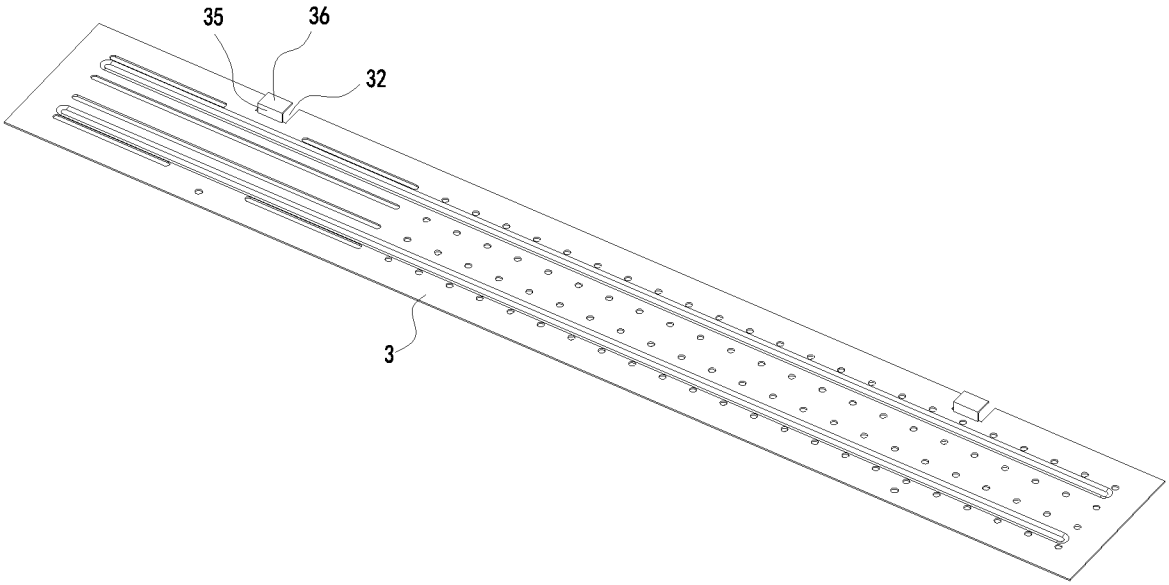
FIG. 20 is a structural diagram of a rear side of a power board according to an embodiment of the present disclosure.

In one embodiment, as shown in FIG. 19 and FIG. 20, the power board 3 is an aluminum plate and has a substantially rectangular plate-like structure, and an upper surface of the power board 3 is provided with two fixing holes 31, two notches 32, a plurality of mounting regions 33, two second reinforcing ribs 34, two supporting sheets 35, two positioning sheets 36 and a mounting groove.

Regarding the fixing holes 31, both of the two fixing holes 31 penetrate the upper surface and a lower surface of the power board 3, one of the fixing holes 31 is arranged on a left side of a front end of the power board 3, and the other of the fixing holes 31 is arranged on a left side of a rear end of the power board 3.

Regarding the notches 32, both of the two notches 32 are recessed inwardly from a right side edge of the power board 3 and penetrate the upper surface and the lower surface of the power board 3, and the two notches 32 are both rectangular-shaped. One of the notches 32 is arranged on a right side of the front end of the power board 3 and is arranged opposite to the fixing hole 31 on the left side of the front end of the power board 3, and the other of the notches 32 is arranged on a right side of the rear end of the power board 3 and is arranged opposite to the fixing hole 31 on the left side of the rear end of the power board 3.

Regarding the mounting regions 33, the plurality of mounting regions 33 are arranged separately at equal intervals, and an arrangement path of the plurality of mounting regions 33 is consistent with a longitudinal direction of the power board 3. Each of the plurality of mounting regions 33 is provided with four mounting holes 331, and the four mounting holes 331 are arranged separately at equal intervals, and an arrangement path of the four mounting holes 331 is consistent with a width direction of the power board 3, that is, the arrangement path of the mounting holes 331 of each of the plurality of mounting regions 33 and the arrangement path of the plurality of mounting regions 33 are perpendicular to each other.

Regarding the second reinforcing ribs 34, two second reinforcing ribs 34 are provided, and the two second reinforcing ribs 34 are both arranged on the upper surface of the power board 3, and extending directions of the two second reinforcing ribs 34 are both consistent with the longitudinal direction of the power board 3. One of the two second reinforcing ribs 34 is arranged at mid-lower portions of the plurality of mounting regions 33, that is, an arrangement path of the one of the two second reinforcing ribs 34 is arranged between lower two mounting holes 331; and the other of the two second reinforcing ribs 34 is arranged at mid-upper portions of the plurality of mounting regions 33, that is, an arrangement path of the other of the two second reinforcing ribs 34 is arranged between upper two mounting holes 331.

Regarding the supporting sheet 35, the supporting sheet 35 has a rectangular sheet-like structure, and both of the supporting sheets 35 are arranged on a back surface of the power board 3 and are perpendicular to the back surface of the power board 3. Positions of the two supporting sheets 35 correspond to positions of the two notches 32, and an orientation of one surface of each supporting sheet 35 is the same as orientations of the notches 32.

Regarding the positioning sheet 36, the positioning sheet 36 has a rectangular sheet-like structure. Referring to the direction shown in FIG. 20, left side surfaces of the two positioning sheets 36 are vertically connected to upper sides of right side surfaces of the two supporting sheets 35, respectively. In this case, the positioning sheets 36 are placed above the back surface of the power board 3, and the positioning sheets 36 are arranged in a state opposite to the notches 32.

Regarding the mounting groove, referring to FIG. 19, the mounting groove is arranged on a right side of the arrangement path of the mounting region 33, and includes four mounting short grooves 371 and two mounting elongated grooves 372. Two mounting short grooves 371 are separately arranged on a left side and a right side of the notch 32 on the right side, and the two mounting short grooves 371 are arranged in a same arrangement path as uppermost mounting holes 331. The other two mounting short grooves 371 are separately arranged on a left side and a right side of the fixing hole 31 on the right side, and the other two mounting short grooves 371 are arranged in a same arrangement path as lowermost mounting holes 331. One of the mounting elongated grooves 372 is arranged below an upper second reinforcing rib 34, and the one of the mounting elongated grooves 372 is arranged in a same arrangement path as mounting holes 331 of a second row from top to bottom. The other mounting elongated groove 372 is arranged above a lower second reinforcing rib 34, and the other mounting elongated groove 372 is arranged in a same arrangement path as mounting holes 331 of a third row from top to bottom.

Referring to FIG. 7, FIG. 19 and FIG. 20, an application process of the power board 3 described above is generally described below.

1. A mounting region 33 or a mounting groove to be applied is selected, and then the power component 6 is mounted on the power board 3 by using screws, nuts, or the like.

2. The fixing holes 31 are passed through by using the screws or nuts, such that the power board 3 is fixed to an outer surface of the electrical board 5, where the electrical board 5 is closed in the lampshade 1.

3. The lampshade 1 is fastened with the bottom cap 4, such that assembly of the lampshade is achieved.

To sum up, the power board 3 described in the embodiment of the present disclosure has at least the following beneficial effects.

1. Position of the mounting holes 331 in the above-mentioned embodiment may be summarized as follows. The power board 3 is provided with the plurality of mounting regions 33, and the plurality of mounting regions 33 each are arranged on the surface of the power board 3. Each of the plurality of mounting regions 33 is provided with at least two mounting holes 331, the mounting holes 331 in each of the mounting regions 33 is arranged on the surface of the power board 3, and the arrangement path of the plurality of the mounting holes 331 is perpendicular to the arrangement path of the plurality of the mounting regions 33. After this structure is satisfied, referring to directions shown in FIG. 19 and FIG. 20, the plurality of mounting regions 33 are arranged in the longitudinal direction of the power board 3, so as to provide a mounting position selection in a first direction for the power component 6, and mounting holes 331 of each mounting region 33 are arranged in the width direction of the power board 3, so as to provide a mounting position selection in a second direction for the power component 6, thereby achieving random mounting of the power component 6 on the power board 3. Moreover, since the power board 3 is arranged to be installed on the electrical board 5 and the electrical board 5 is arranged to be installed in the lampshade 1, the power component 6 is fixed to the outside of the lampshade 1. As long as the lampshade 1 is detached from the bottom cap 4, the power component 6 can be directly overhauled, which also provides convenience for maintainers.

2. The structure of the second reinforcing rib 34 in the above-mentioned embodiment may be summarized as follows. The surface of the power board 3 is provided with the second reinforcing rib 34, and the arrangement path of the second reinforcing rib 34 is consistent with the arrangement path of the plurality of mounting regions 33. After the plurality of mounting holes 331 are provided, the mechanical strength of the power board 3 will decrease, while the addition of the second reinforcing rib 34 can reinforce the power board 3, and since the second reinforcing rib 34 has a same arrangement path as the plurality of mounting regions 33, all parts where the mechanical strength is weakened can be reinforced.

3. A position of the second reinforcing rib 34 in the above-mentioned embodiment may be summarized as follows. Each of the mounting regions 33 has two adjacent mounting holes 331 arranged on two opposite sides of the second reinforcing rib 34. A position where the two mounting holes 331 are continuously provided is apparently weaker in strength than a continuous flat-plate structure. Through this arrangement manner, the second reinforcing rib 34 can pass between two mounting holes 331 of each mounting region 33 to further reinforce the part where the mechanical strength is weakened.

4. The relationship between the mounting holes 331 and the second reinforcing ribs 34 in the above-mentioned embodiment may be summarized as follows. At least three mounting holes 331 in each mounting region 33 are provided, and at least two second reinforcing ribs 34 are provided. Since some power components 6 need to be installed by using two mounting holes 331, by providing at least three mounting holes 331 in each mounting region 33, it can be ensured that the power component 6 still has a space for selecting a mounting position in the width direction of the power board 3; and by providing at least two second reinforcing ribs 34, it can be ensured that the power board 3 still has a better mechanical strength even when the number of mounting holes 331 increases.

5. The structure of the fixing hole 31 in the above-mentioned embodiment may be summarized as follows. The power board 3 is provided with at least two fixing holes 31, and the fixing holes 31 are arranged outside the range covered by the mounting region 33. The purpose of adding the fixing hole 31 is to avoid occupying the mounting holes 331, such that the fixing holes 31 are used solely for fixing the power board 3 and the electrical board 5, and the mounting holes 331 are used solely for fixing the power component 6 and the power board 3, so as to prevent a mounting position for the power component 6 from being occupied due to fixation of the power board 3 and the electrical board 5 by using the mounting holes 331.

6. The structure of the notch 32 in the above-mentioned embodiment may be summarized as follows. An edge of the power board 3 is provided with the notch 32, the number of notches 32 is the same as the number of fixing holes 31, positions of the notches 32 are in one-to-one correspondence with positions of the fixing holes 31, and each of the notches 32 and each of the fixing holes 31 are arranged on two sides of the power board 3, respectively, and opposite to each other. Since the electrical board 5 is provided with a positioning block, after the notch 32 is added on the power board 3, positioning can be carried out by using the notch 32 and the positioning block. As long as the positioning block is embedded in the notch 32, rapid positioning and installation of the power board 3 and the electrical board 5 can be achieved.

7. In one embodiment, the structure of the notch 32 in the above-mentioned embodiment may further be summarized as follows. The notch 32 is arranged outside the range covered by the plurality of the mounting regions 33. In this way, the notch 32 can be prevented from being arranged between the plurality of mounting holes 33, and the position of the positioning block of the electrical board 5 is prevented from corresponding to a position where the power component 6 needs to be mounted, thereby ensuring smooth mounting.

8. The positional relationship between the supporting sheet 35 and the positioning sheet 36 in the above-mentioned embodiment may be summarized as follows. One surface of the power board 3 is provided with the supporting sheet 35 extending in a direction facing away from the surface of the power board 3. One surface of the supporting sheet 35 is connected to the positioning sheet 36, where the surface of the supporting sheet 35 has a same orientation as the notch 32, and the positioning sheet 36 is separated from the surface of the power board 3 and is arranged opposite to the notch 32. After this structure is satisfied, the positioning sheet 36 is arranged below the notch 32, such that when the power board 3 is assembled with the electrical board 5, the positioning sheet 36 can be inserted into the positioning block of the electrical board 5, thereby further enhancing the mounting firmness of the power board 3 and the electrical board 5.

9. The positional relationship between the supporting sheet 35 and the positioning sheet 36 in the above-mentioned embodiment may be summarized as follows. The supporting sheet 35 is arranged outside the mounting region 33, the supporting sheet 35 is perpendicular to the surface of the power board 3, and the positioning sheet 36 is perpendicular to the surface of the supporting sheet 35. After this structure is satisfied, the supporting sheet 35 will not block the mounting region 33, thereby avoiding affecting the mounting and fixation of the power component 6.

10. The structure of the mounting groove in the above-mentioned embodiment may be summarized as follows. The surface of the power board 3 is provided with a plurality of mounting grooves, the mounting grooves are arranged at the arrangement path of the plurality of the mounting regions 33, and the arrangement path of the mounting grooves is consistent with the arrangement path of the plurality of the mounting regions 33. After this structure is satisfied, the mounting grooves and the plurality of mounting regions 33 are arranged in the longitudinal direction of the power board 3. For a power component 6 having a standard-size mounting position, the power component 6 can be directly mounted in two mounting holes 331 for fixation; and for a power component 6 having a non-standard-size mounting position, one portion of the power component 6 can be mounted in the mounting holes 331 and the other portion can be mounted in the mounting groove, such that the power board 3 has a wider application range.

Figure 24:
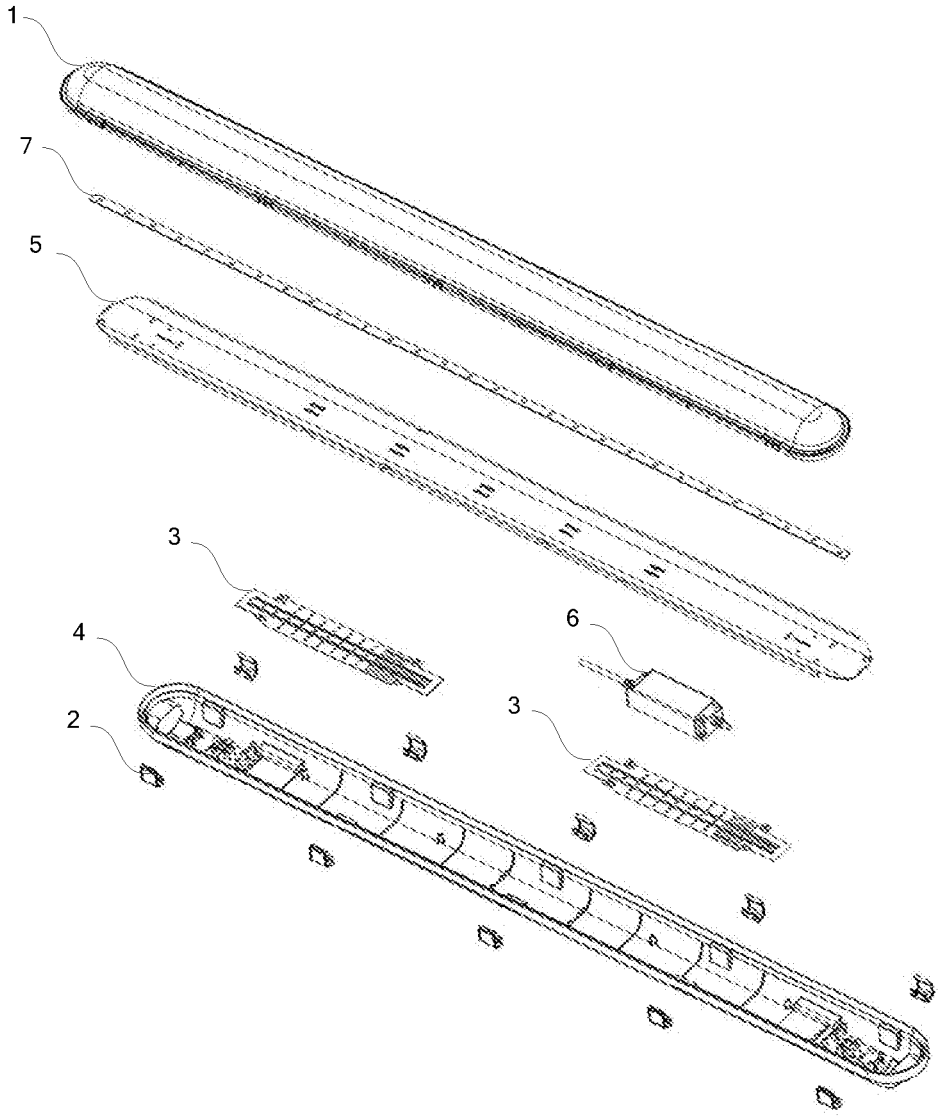
FIG. 24 is an exploded view of a lamp according to another embodiment of the present disclosure.

In one embodiment, as shown in FIG. 24, the lamp in the embodiment of the present disclosure includes the simple fastener 2, the bottom cap 4, the power component 6, the power board 3, the electrical board 5 and the lampshade 1 in the above-mentioned embodiment. The electrical board 5 is configured to fix a light bar 7, the electrical board 5 to which the light bar 7 is fixed is fastened to the interior of the lampshade 1, the power board 3 is installed in the bottom cap 4 by using screws, the power component 6 is installed on the power board 3 by using screws, the bottom cap 4 is fastened to the lampshade 1 so as to surround the power component 6, and the bottom cap 4 is fastened and fixed to the lampshade 1 by using simple fasteners 2.

In this embodiment, by fixing the power board 3 and the power component 6 on the bottom cap 4, the power board 3 and the power component 6 do not need to be loaded on the lampshade 1, such that the weight of the lampshade 1 can be reduced and the lampshade 1 can be easily assembled.

Figure 25:
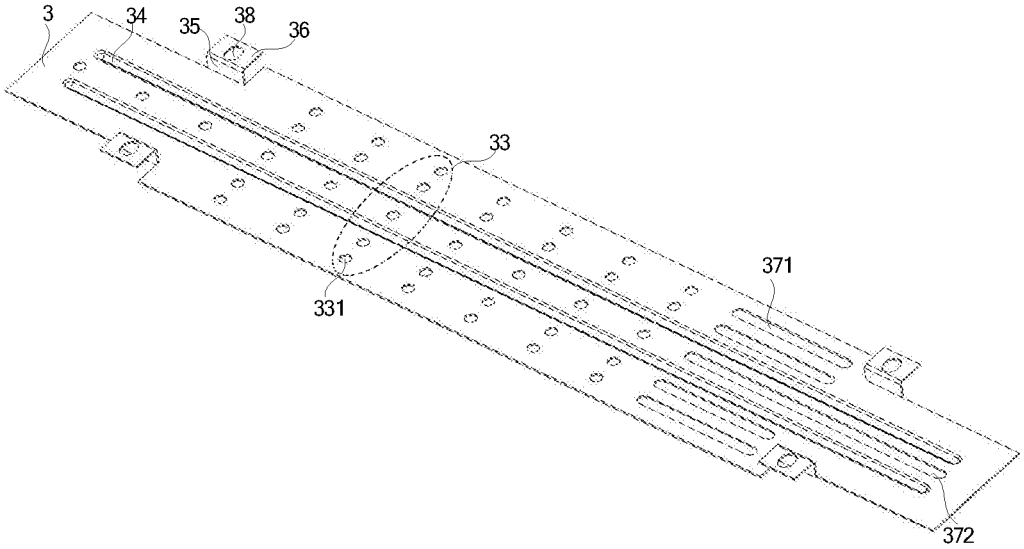
FIG. 25 is a structural diagram of a front side of a power board according to another embodiment of the present disclosure.

In one embodiment, as shown in FIG. 25, the power board 3 has a substantially rectangular plate-like structure, and the power board 3 is provided with four notches 32, the plurality of mounting regions 33, two second reinforcing ribs 34, four supporting sheets 35, four positioning sheets 36 and the mounting groove.

Referring to the direction shown in FIG. 25, two notches 32 are arranged on a left side of the power board 3, and the other two notches 32 are arranged on a right side of the power board 3 and are arranged opposite to the two notches 32 on the left side of the power board 3 in one-to-one correspondence, respectively.

The plurality of mounting regions 33 are arranged separately at equal intervals, and an arrangement path of the plurality of mounting regions 33 is consistent with a longitudinal direction of the power board 3. Each of the plurality of mounting regions 33 is provided with five mounting holes 331, and the five mounting holes 331 are arranged separately at equal intervals, and an arrangement path of the five mounting holes 331 is consistent with a width direction of the power board 3, that is, the arrangement path of the mounting holes 331 of each of the plurality of mounting regions 33 and the arrangement path of the plurality of mounting regions 33 are perpendicular to each other.

The two second reinforcing ribs 34 are both arranged on an upper surface of the power board 3, and extending directions of the two second reinforcing ribs 34 are consistent with the longitudinal direction of the power board 3. One second reinforcing rib 34 is arranged between an intermediate mounting hole 331 of each mounting region 33 and one mounting hole 331 adjacent to the intermediate mounting hole 331, and the other second reinforcing rib 34 is arranged between the intermediate mounting hole 331 of each mounting region 33 and the other mounting hole 331 adjacent to the intermediate mounting hole 331.

Each supporting sheet 35 has a rectangular sheet-like structure, and all the four supporting sheets 35 are arranged on a front surface of the power board 3 and are perpendicular to the front surface of the power board 3. Positions of the four supporting sheets 35 correspond to positions of the four notches 32, and an orientation of one surface of each supporting sheet 35 is the same as an orientation of the notch 32 at a corresponding position.

Each positioning sheet 36 has a rectangular sheet-like structure, referring to the direction shown in FIG. 25, left side surfaces of two positioning sheets 36 are vertically connected to upper sides of right side surfaces of the two supporting sheets 35 in one-to-one correspondence, and right side surfaces of the other two positioning sheets 36 are vertically connected to upper sides of left side surfaces of the two supporting sheets 35 in one-to-one correspondence. In this case, four positioning sheets 36 are arranged above the front surface of the power board 3, and the four positioning sheets 36 are arranged in a state opposite to the four notches 32 in one-to-one correspondence. Moreover, each positioning sheet 36 is provided with a first assembly hole 38.

The mounting groove includes four mounting short grooves 371 and one mounting elongated groove 372, where the mounting elongated groove 372 is arranged on a same arrangement path as intermediate mounting holes 331 of the plurality of mounting regions 33, and the four mounting short grooves 371 are arranged on same arrangement paths as remaining four mounting holes 331 of the plurality of mounting regions 33, respectively.

Figure 26:
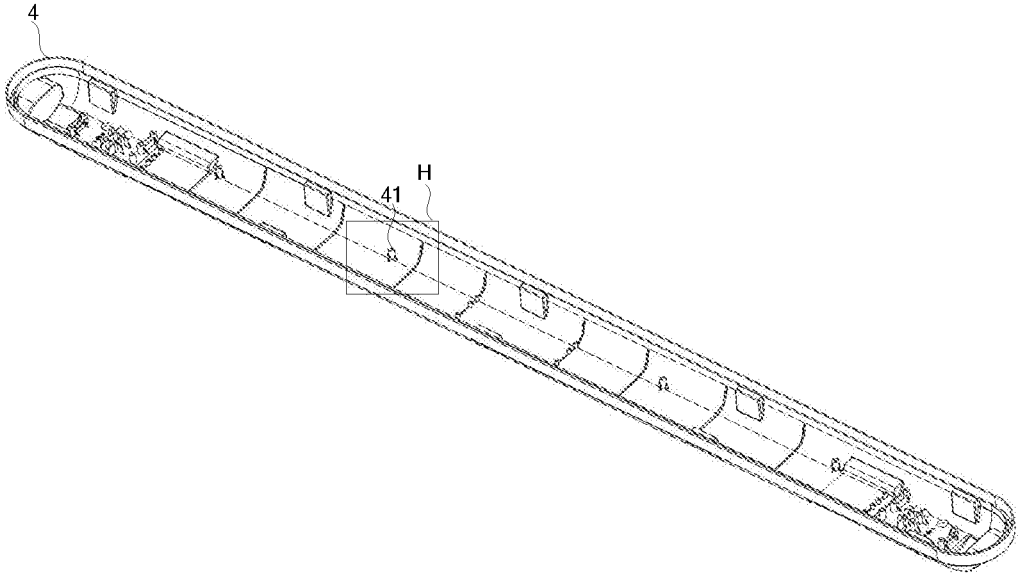
FIG. 26 is a structural diagram of a bottom cap according to an embodiment of the present disclosure.
Figure 27:
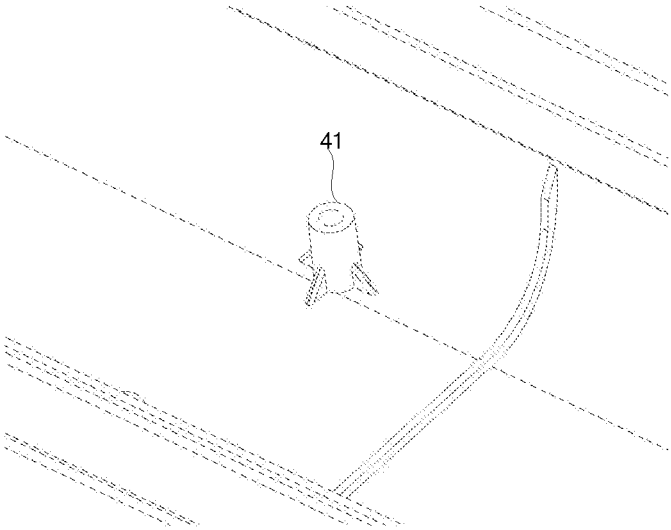
FIG. 27 is an enlarged view of a portion H in FIG. 26.

In one embodiment, as shown in FIG. 26 and FIG. 27, a plurality of mounting posts 41 are arranged in the bottom cap 4, and each mounting post 41 has threads. When the power board 3 is installed, a plurality of first mounting holes 37 of the power board 3 can be sleeved on the plurality of mounting posts 41 in one-to-one correspondence, a plurality of screws can be screwed into the plurality of mounting posts 41 in one-to-one correspondence, thereby the power board 3 is fixed to the bottom cap 4.

Figure 28:
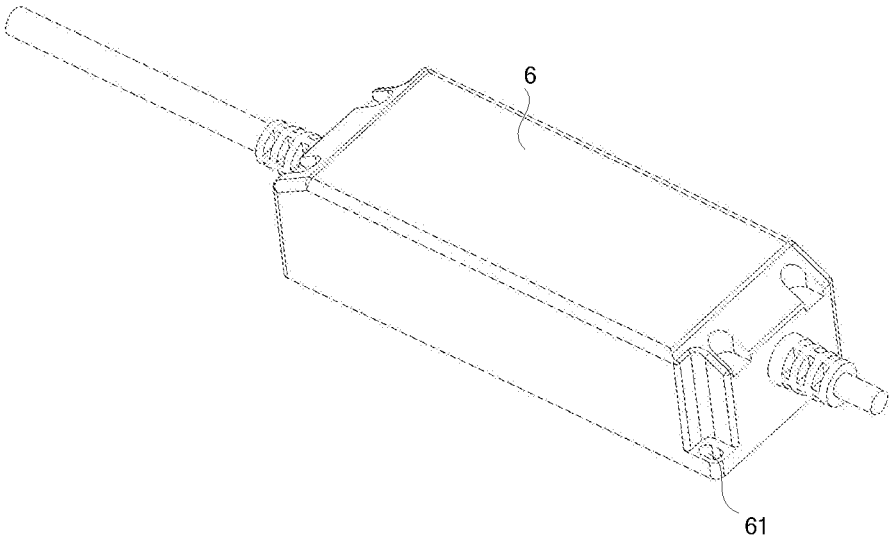
FIG. 28 is a structural diagram of a power component according to an embodiment of the present disclosure.

In one embodiment, as shown in FIG. 28, the power component 6 is provided with a second assembly hole 61. When the power component 6 is mounted on the power board 3, the second mounting hole 61 may be aligned with the mounting hole 331, and then the second assembly hole 61 is fixed to the mounting hole 331 by using screws.

Functions of the mounting region 33, the second reinforcing rib 34, and the mounting groove have been described in the above-mentioned embodiment, and will not be repeated in this embodiment.

In one embodiment, for a power component 6 having a standard size, the power component 6 can be directly fixed through the mounting hole 331; and for a power component 6 having a non-standard size, one portion of the power component 6 can be fixed through the mounting hole 331 and the other portion can be fixed through the mounting groove, such that the power board 3 has a wider application range.

In one embodiment, the power board 3 is not limited to an aluminum plate, that is, the power board 3 may be an iron plate or an aluminum plate. Using such raw materials to manufacture the power board 3 can not only ensure the mechanical strength of the power board 3, but also ensure a relatively reasonable manufacturing cost.

The above are embodiments of the present disclosure.

What is claimed is:

1. A lampshade, comprising:

a lampshade bottom, wherein an accommodation cavity is formed by an inner surface of the lampshade bottom, an end surface is provided on an outside of the lampshade bottom, and the end surface is arranged around the accommodation cavity;

a lampshade wall arranged on the end surface, wherein the lampshade wall is arranged around the accommodation cavity, a platform surface is provided between an inner surface of the lampshade wall and the inner surface of the lampshade bottom, and the platform surface is arranged around the accommodation cavity;

at least two stop blocks, wherein the at least two stop blocks are both arranged on the inner surface of the lampshade wall and are separately arranged along an arrangement path of the lampshade wall; and at least two clamping blocks, wherein the at least two clamping blocks are both arranged on the platform surface and are separately arranged along an arrangement path of the platform surface, wherein the lampshade wall comprises a first straight plate, a second straight plate, a first arc plate and a second arc plate, wherein the first straight plate and the second straight plate are parallel and opposite to each other, a first end of the first straight plate is connected and transitioned to a first end of the second straight plate through the first arc plate, and a second end of the first straight plate is connected and transitioned to a second end of the second straight plate through the second arc plate; and the at least two stop blocks are arranged on an inner surface of the first straight plate and an inner surface of the second straight plate, respectively, and the at least two clamping blocks are arranged at a position of the platform surface corresponding to an arrangement path of the first straight plate and a position of the platform surface corresponding to an arrangement path of the second straight plate, respectively;

wherein the inner surface of the lampshade bottom is provided with a plurality of bosses, and the plurality of bosses are separately arranged according to the arrangement path of the lampshade wall.

2. The lampshade of claim 1, wherein the at least two clamping blocks each comprise a first baffle and a second baffle; wherein the first baffle is perpendicular to the first straight plate, a first end of the first baffle extends to the first straight plate, a second end of the first baffle is connected to the second baffle, and the second baffle is parallel to the first straight plate.

3. The lampshade of claim 2, wherein the first end of the first baffle extending to the first straight plate comprises that the first end of the first baffle extends to the first straight plate and is fixedly connected to the first straight plate.

4. The lampshade of claim 1, wherein each of the at least two clamping blocks is a straight plate, and the straight plate is arranged parallel to the first straight plate.

5. The lampshade of claim 1, wherein each of the at least two clamping blocks is arranged between two stop blocks of the at least two stop blocks.

6. The lampshade of claim 1, wherein one surface of each of the plurality of bosses is flush with the platform surface.

7. The lampshade of claim 1, wherein an outer surface of the lampshade bottom is provided with a plurality of grooves, and concave portions of the plurality of the grooves are arranged in interiors of the plurality of bosses in one-to-one correspondence.

8. The lampshade of claim 7, wherein the outer surface of the lampshade bottom is provided with a plurality of fastening positions, and the plurality of the grooves are one-to-one correspondingly arranged in ranges covered by the plurality of the fastening positions.

9. The lampshade of claim 1, wherein each of the at least two stop blocks has a columnar structure with a right-angled trapezoid cross-section.

10. The lampshade of claim 9, wherein in the columnar structure, a plane where a straight-side waist of a right-angled trapezoid is located faces towards the platform surface, a plane where a bevel-side waist of the right-angled trapezoid is located faces away from the platform surface, and a plane where a lower bottom of the right-angled trapezoid is located is connected to the inner surface of the first straight plate.

11. The lampshade of claim 1, wherein each of the at least two stop blocks is formed by slotting in a columnar structure with a right-angled trapezoid cross-section.

12. A lamp, comprising a lampshade, wherein the lampshade comprises:

a lampshade bottom, wherein an accommodation cavity is formed by an inner surface of the lampshade bottom, an end surface is provided on an outside of the lampshade bottom, and the end surface is arranged around the accommodation cavity;

a lampshade wall arranged on the end surface, wherein the lampshade wall is arranged around the accommodation cavity, a platform surface is provided between an inner surface of the lampshade wall and the inner surface of the lampshade bottom, and the platform surface is arranged around the accommodation cavity;

at least two stop blocks, wherein the at least two stop blocks are both arranged on the inner surface of the lampshade wall and are separately arranged along an arrangement path of the lampshade wall; and at least two clamping blocks, wherein the at least two clamping blocks are both arranged on the platform surface and are separately arranged along an arrangement path of the platform surface, wherein the lampshade wall comprises a first straight plate, a second straight plate, a first arc plate and a second arc plate, wherein the first straight plate and the second straight plate are parallel and opposite to each other, a first end of the first straight plate is connected and transitioned to a first end of the second straight plate through the first arc plate, and a second end of the first straight plate is connected and transitioned to a second end of the second straight plate through the second arc plate; and the at least two stop blocks are arranged on an inner surface of the first straight plate and an inner surface of the second straight plate, respectively, and the at least two clamping blocks are arranged at a position of the platform surface corresponding to an arrangement path of the first straight plate and a position of the platform surface corresponding to an arrangement path of the second straight plate, respectively;

wherein the inner surface of the lampshade bottom is provided with a plurality of bosses, and the plurality of bosses are separately arranged according to the arrangement path of the lampshade wall.

13. The lamp of claim 12, wherein the at least two clamping blocks each comprise a first baffle and a second baffle; wherein the first baffle is perpendicular to the first straight plate, a first end of the first baffle extends to the first straight plate, a second end of the first baffle is connected to the second baffle, and the second baffle is parallel to the first straight plate.

14. The lamp of claim 13, wherein the first end of the first baffle extending to the first straight plate comprises that the first end of the first baffle extends to the first straight plate and is fixedly connected to the first straight plate.

15. The lamp of claim 12, wherein each of the at least two clamping blocks is a straight plate, and the straight plate is arranged parallel to the first straight plate.

16. The lamp of claim 12, wherein each of the at least two clamping blocks is arranged between two stop blocks of the at least two stop blocks.

* * * * *